United States Patent [19]

Hare

[11] 4,224,358

[45] Sep. 23, 1980

[54] T-SHIRT COLORING KIT

[76] Inventor: Donald S. Hare, 4 Lexington Ave., New York, N.Y. 10010

[21] Appl. No.: 954,228

[22] Filed: Oct. 24, 1978

Related U.S. Application Data

[63] Continuation-in-part of Ser. No. 933,027, Aug. 11, 1978, abandoned.

[51] Int. Cl.[3] ..... B41M 3/12

[52] U.S. Cl. ..... 427/147; 156/235; 427/148; 427/152; 427/288; 428/914; 428/485; 428/488

[58] Field of Search ..... 156/230, 235, 240; 35/26; 427/147, 148, 152; 428/914, 485, 488, 288

[56] References Cited

U.S. PATENT DOCUMENTS

| | | | |
|---|---|---|---|
| Re. 20,694 | 4/1938 | Miller | 156/235 |
| 1,289,342 | 12/1918 | Witte | 35/26 |
| 2,016,599 | 10/1935 | Graves | 156/230 |
| 2,593,923 | 4/1952 | Roddin et al. | 427/147 X |
| 3,256,618 | 6/1966 | Varsky et al. | 35/26 |
| 3,294,612 | 12/1966 | Pail et al. | 156/235 |
| 4,012,552 | 3/1977 | Watts | 427/147 X |
| 4,103,053 | 7/1978 | Barehas | 156/240 |

FOREIGN PATENT DOCUMENTS

| | | | |
|---|---|---|---|
| 133543 | 10/1919 | United Kingdom | 35/26 |
| 906934 | 9/1962 | United Kingdom | 427/147 |

*Primary Examiner*—Shrive P. Beck

*Attorney, Agent, or Firm*—Birch, Stewart, Kolasch & Birch

[57] ABSTRACT

The present invention is directed to a kit and method for applying colored emblems to T-shirts and the like. The kit includes a transfer sheet having an outlined pattern thereon and a plurality of selected colored crayons formed of a heat transferable material, such as colored wax. The method of transferring a colored emblem to a T-shirt or the like includes the steps of applying the colored wax to the heat transfer sheet, positioning the heat transfer sheet on a T-shirt or the like, applying a heated intrument to the reverse side of the heat transfer sheet thereby transferring the colored wax to the T-shirt or the like. In another preferred embodiment, the transferable pattern is created from a manifold of a heat transfer sheet and a reversed or lift type copy sheet having a pressure transferable coating of heat transferable material thereon. By generating a pattern on the obverse face of the transfer sheet with the pressure of a drafting implement a heat transferable mirror image pattern is created or the reverse form thereof by pressure transfer which can then be applied to a T-shirt or other article by heat transfer. Different colors of transferable coatings on various copy sheets are manifolded with the heat transfer sheet to effectuate multi-colored heat transferable patterns on the rear surface of the transfer sheet.

2 Claims, 5 Drawing Figures

T-SHIRT COLORING KIT

This is a Continuation-in-part application of Ser. No. 933,027, filed Aug. 11, 1978 now abandoned.

BACKGROUND OF THE INVENTION

1. Field of the Invention

The present invention is directed to a kit for applying and a method of transferring a colored emblem to a T-shirt or the like.

2. Description of the Prior Art

Many exemplary heat transferable or pressure transferable decals for placing a color emblem on a fabric or other receptor sheet are illustrated in the prior art. For example, U.S. Pat. No. 2,071,163 to Emmey discloses a transfer sheet 13 having colored areas 14, 15 thereon formed from a heat transferable wax. The heat transferable wax 14, 15 is applied to the transfer sheet 13 in a melted state at the time of manufacture of the transfer sheet.

U.S. Pat. No. 2,217,270 to Gibbs and U.S. Pat. No. 2,688,579 to Meyer disclose other forms of precolored transfer sheets. The transfer sheets in these patents, like the transfer sheet of Emmey, are precolored at the time of manufacture of the transfer sheet.

U.S. Pat. No. 3,783,073 to Warnberg and U.S. Pat. No. 4,038,123 to Simms disclose devices for transferring outlines of indicia to fabrics.

Each of the foregoing patents suffers from the disadvantage that they do not permit or encourage custom coloring of the design transferred to the fabric by the consumer.

At least one custom coloring procedure for applying color designs to T-shirts or other fabrics is known. In this procedure, fabric crayons are sold separately in combination with T-shirts, which have outlines of the designs applied thereto, and the consumer uses the fabric crayons to color directly on the fabric or the T-shirt. This method of coloring is totally unsatisfactory, since the flexibility of the fabric prevents smooth and fluid strokes and creates tension which prevents an even application of color from the crayons.

Another custom coloring procedure for transferring coloring designs to materials other than fabrics is described in U.S. Pat. No. 3,785,912 to VanDuesen, which discloses transferring a pattern or outline to a receptor sheet and subsequently coloring the receptor sheet with a conventional felt tip pen. This is essentially the same procedure described above with respect to the custom coloring of T-shirts.

The transfer kits for applying colored emblems to a T-shirt or the like disclosed in each of the above-mentioned procedures suffer from disadvantages which are solved by the kit for applying, and method for transferring, colored emblems disclosed in the present invention. More particularly, the present invention sets forth a novel kit for applying colored emblems to a T-shirt or the like which includes a transfer sheet having an outlined pattern thereon and a plurality of selected colored crayons formed of a heat transferable material, such as colored wax. The method of transferring a colored emblem to a T-shirt or the like includes the steps of: applying the colored crayons to a transfer sheet within the outlined pattern; positioning the transfer sheet on a T-shirt or the like; and applying a heated instrument to the reverse side of the transfer sheet thereby transferring the colored emblem and the outlined pattern to the T-shirt or the like.

In another preferred embodiment, the transferable pattern is created from a manifold of a heat transfer sheet and a reversed or lift type copy sheet having a pressure transferable coating of heat transferable material thereon. By generating a pattern on the obverse face of the transfer sheet with the pressure of a drafting implement a heat transferable mirror image pattern is created on the reverse face thereof by pressure transfer which can then be applied to a T-shirt or other article by heat transfer. Different colors of transferable coatings on various copy sheets are manifolded with the heat transfer sheet to effectuate multi-colored heat transferable patterns on the rear surface of the transfer sheet.

SUMMARY OF THE INVENTION

It is an object of the present invention to provide a kit for applying a colored emblem to a T-shirt or the like.

A further object of the present invention is to provide a transfer sheet which includes the outline of a mirror image of a specific message together with any desired fanciful design.

A still further object of the present invention is to provide a transfer sheet with a specific outline thereon so that an individual may neatly apply the colored crayons in clear smooth lines within the outline to thereby enhance the appearance of the image which will be subsequently transferred onto a T-shirt or the like.

Another object of the present invention is to provide a kit which will encourage consumer involvement and utilize the talents and creativity of the consumer in coloring the design.

Yet another object of the present invention is to provide a combined transfer sheet and copy sheets wherein the copy sheets are coated with a pressure transferable heat transferable material and a mirror image pattern is generated on the reverse face of the transfer sheet from the copy sheets in response to a pressure generating drafting implement applied to the obverse face of the transfer sheet to generate a desired pattern on that obverse face, the transfer sheet may subsequently be used to apply the mirror image pattern, by heat transfer, to a T-shirt or other article.

These and other objects of the present invention are accomplished by providing a kit for applying a method of transferring colored emblems to a T-shirt or the like which includes a transfer sheet having an outlined pattern thereon and a plurality of selected, colored crayons formed of a heat transferable material, such as colored wax. One preferred method of transferring a colored emblem to a T-shirt or the like of the present invention includes the steps of: applying the colored crayons to the transfer sheet; positioning the transfer sheet on a T-shirt or the like and applying a heated instrument to the reverse side of the transfer sheet thereby transferring the colored emblem to the T-shirt or the like.

Another preferred kit method of the present invention for transferring either a single or multi-colored emblem to a T-shirt or the like includes: a transfer sheet having either a pre-printed emblem or pattern or a free form pattern generating space on the obverse face thereof. The reverse face of the transfer sheet is juxtaposed with one or more copy sheets (one at a time) each of which is coated on its juxtaposable surface with selected colors of heat transferable crayon wax or like material which is also pressure transferable from the said copy sheet to the reverse surface of the transfer sheet. This provides the means by which a mirror image pattern of the obverse surface pattern can be created on the reverse surface of the transfer sheet in response to pressure such as generated by a ball pen, pencil point or the like against the said obverse surface.

Selected portions of the obverse pattern can be generated or traced or followed in conjunction with respectively different ones of the selectively colored copy sheets to produce a multi-colored mirror image pattern. The latter is heat transferable to a T-shirt or the like in like manner to the previous embodiment.

However, the use of the copy sheets provides even better uniformity of color and the pressure of the obverse pattern provides a much improved visual alignment capability with the T-shirt or other article since the heat transferable mirror image is fully in registry with the obverse image.

Although it is preferred to transfer the colored design from the transfer sheet to the fabric by the application of heat, other forms of energy than heat may be utilized. For example pressure may be applied, such as by rubbing or stamping, to effect transfer of the colored design.

Further scope of applicability of the present invention will become apparent from the detailed description given hereinafter. However, it should be understood, that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWING

The present invention will become more fully understood from the detailed description given hereinbelow and the accompanying drawing which is given by way of illustration only, and thus is not limitative of the present invention, and wherein.

DETAILED DESCRIPTION OF THE INVENTION

Figure 1:
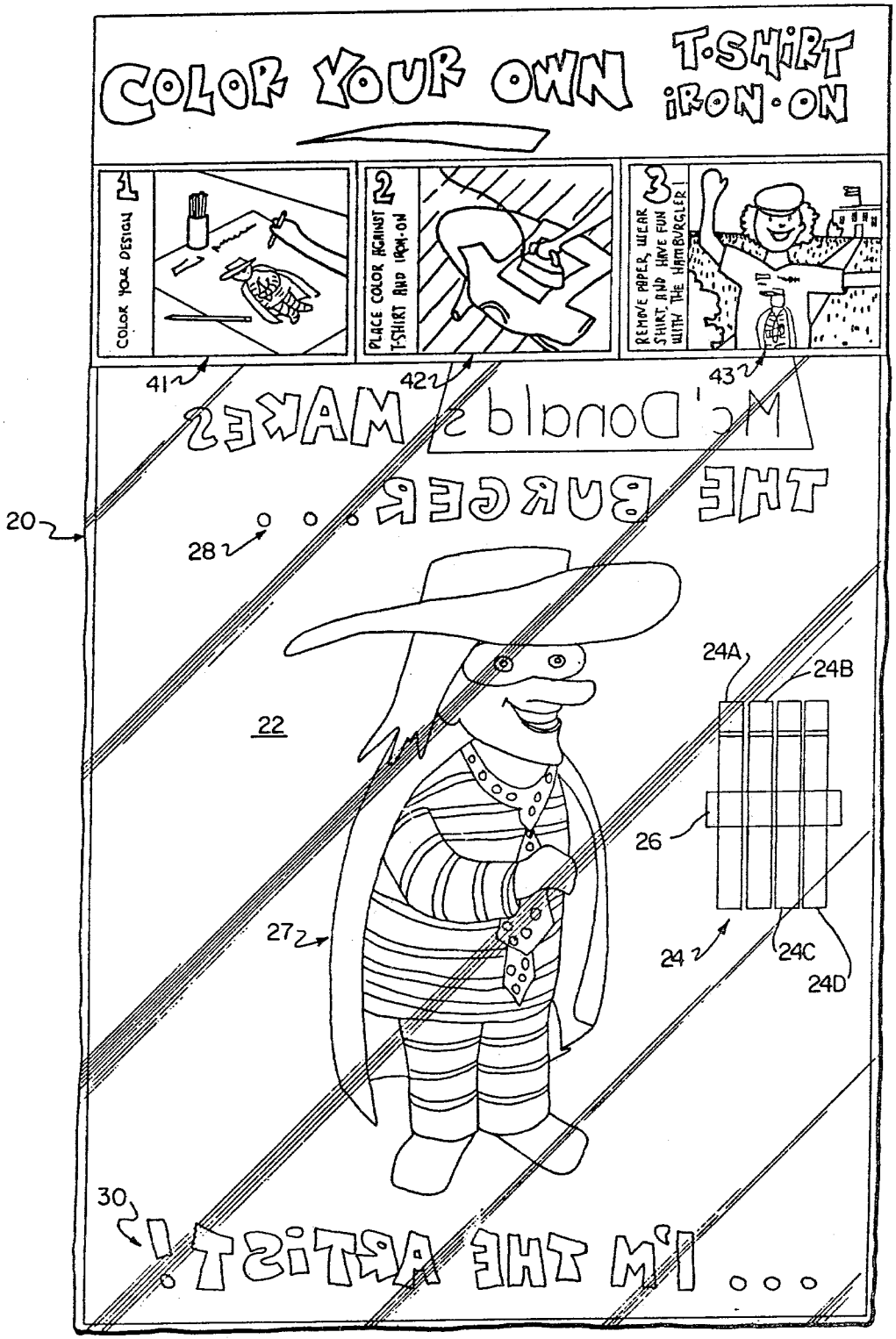
FIG. 1 illustrates a kit according to the present invention including a transfer sheet and a plurality of colored crayons.
Figure 2:
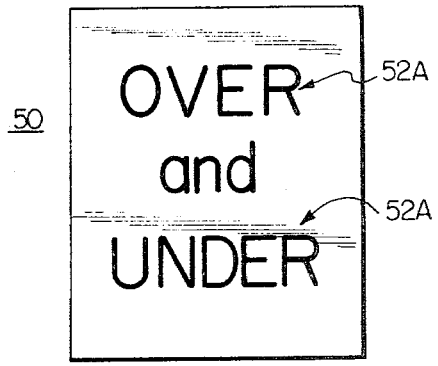
FIG. 2 is a top plan view of a transfer sheet illustrating the obverse face thereof and a pattern thereon.

The present invention is directed to a kit for applying, and a method of transferring, colored emblems onto a T-shirt or the like. As illustrated in FIG. 1, in one embodiment of the present invention, the kit is positioned within a plastic bag 20 and includes a transfer sheet 22, a plurality of colored crayons 24 and instructions 41–43.

According to this embodiment of the present invention, the transfer sheet 22 may include the outline of a message 28, 30 and a fanciful drawing 27. As illustrated in FIG. 1, the specific message 28, 30 is a mirror image of the message which will be transferred onto a T-shirt or the like. The mirror image of the message 28, 30 is outlined in a transfer ink which will subsequently be transferred to a T-shirt or the like when an individual applies a heated instrument to the reverse side of the transfer sheet. In the alternative the outline may be transferred by the application of pressure.

The kit for applying colored emblems to a T-shirt or the like includes a plurality of selected colored crayons 24 which are formed of a heat transferable material, such as colored wax. The individual crayons 24A, 24B, 24C and 24D may be secured together by a band 26. Although not illustrated in the drawing, the individual crayons may be positioned within a second plastic bag to ensure that the crayons do not damage the transfer sheet during shipping.

The preferred crayons 24A–24D are specially formulated to melt under the application of heat and penetrate into a fabric. In addition, the colors of the crayons do not run when the T-shirt or the like is laundered. In the alternative the crayons may be made of material which is transferable by the application of pressure such as by rubbing, stamping, etc.

The plastic bag 20 in which the kit for applying colored emblems to a T-shirt or the like includes instructional indicia at the top thereof. As illustrated in FIG. 1, step 1 of the instructional indicia informs an individual that the outlined message and fanciful design should be colored with one of the plurality of crayons 24A–24D. An individual may utilize the outline as a guide so that he/she may neatly color the transfer sheet. In addition, since the transfer sheet is a smooth flat surface an individual may easily color the transfer sheet. This is a distinct improvement over the prior art in which fabric crayons are applied directly to a T-shirt. Since the T-shirt is flexible it is extremely difficult to apply the fabric crayons to the T-shirt. Further, since the T-shirt lacks the advantage of a predrawn outline which allows for a neat and orderly finished product, the T-shirt of the prior art is usually not esthetically attractive.

After an individual has utilized the crayons 24A–24D to color the oulined message and fanciful design, he/she would subsequently transfer the colored emblem onto a T-shirt or the like. As illustrated in FIG. 1, step 2 of the instructional indicia, a heated instrument would be applied to the reverse surface of the transfer sheet 22 to thereby transfer the colored emblem onto a T-shirt or the like. If a heated instrument or pressure is applied to the reverse side of the transfer sheet 22, the fabric crayon composition and the outline transfer ink will penetrate into the fabric of the T-shirt or the like.

The heated instrument for transferring the colored emblem onto a T-shirt or the like may be a conventional iron. However, other heated instruments which would be suitable for applying heat to the transfer sheet to thereby melt the crayon composition and outline transfer ink may be utilized in combination with the present invention.

The composition of the crayons are specially formulated to be color-fast when laundered. Therefore, the specific message and fanciful design which is transferred onto a T-shirt or the like will not run when the T-shirt or the like is laundered. Further, since the specific message and fanciful design is outlined in transfer ink an individual may readily color within the outline. Therefore, since the transfer sheet 22 is flat and an individual may readily utilize the outline when coloring, the finished product is neat and orderly.

As illustrated in FIG. 1, step 3 of the instructional indicia shows an individual wearing the esthetically attractive T-shirt made with the kit of the present invention. Because an individual was personally involved with supplying the coloring to the outline of the specific message and fanciful design and because the finished product is neat and orderly, an individual is usually extremely proud to wear the T-shirt or the like with the colored emblem applied thereto. Further, since an individual utilized his/her own creative talents in supplying the colors to the transfer sheet 22 a great deal of personal satisfaction is achieved by utilizing the kit of the present invention.

It should be understood, that although FIG. 1 of the drawings illustrates a specific message together with a fanciful design, any fanciful design may be utilized in combination with the present invention. Further, a blank transfer sheet may be supplied so that an individual may utilize his/her own creativity in formulating a message and/or design which will be subsequently transferred onto a T-shirt or the like.

According to another embodiment of the present invention, a plurality of transfer sheets 22 may be supplied within a plastic bag 20. The plurality of transfer sheets may be in the form of a booklet or may be loosely positioned within the plastic bag.

The kit of the present invention may be readily used as a promotional gimmick. A store may have a specific message printed on the transfer sheets 22 together with a specific fanciful design. The kit of the present invention may be sold at a minimum price or may be distributed free so as to attract business.

One preferred method of the present invention includes the steps of applying the colored crayons to the transfer sheet 22. The transfer sheet 22 is then positioned on a T-shirt or the like. Subsequently, a heated instrument is applied to the reverse side of the transfer sheet 22 to melt the crayon composition thereby transferring the colored emblem onto the T-shirt or the like.

Another preferred embodiment of the present invention will now be described with reference to FIGS. 2, 3, 4 and 5.

Referring in detail to FIGS. 2, 3, 4 and 5, another preferred embodiment is shown as including a transfer sheet 50 having an obverse surface 50A and a reverse surface 50B with a pattern, hereinafter referred to as the obverse pattern 52A either printed upon or adapted to be generated upon the obverse surface 50A by free-form drafting.

A copy sheet 54 is provided which has a surface layer 56 consisting of a pressure transferable and heat transferable colored wax or other suitable substance having these characteristics over a substrate 58 of conventional paper or plastic or the like, the substrate 58 acting as a supporting surface for the transferable wax or other material 56.

The copy sheet 54 is manifolded with the transfer sheet 50 such that the transferable material layer 56 is juxtaposed with the reverse surface 50B of the copy sheet 50.

Figure 3:
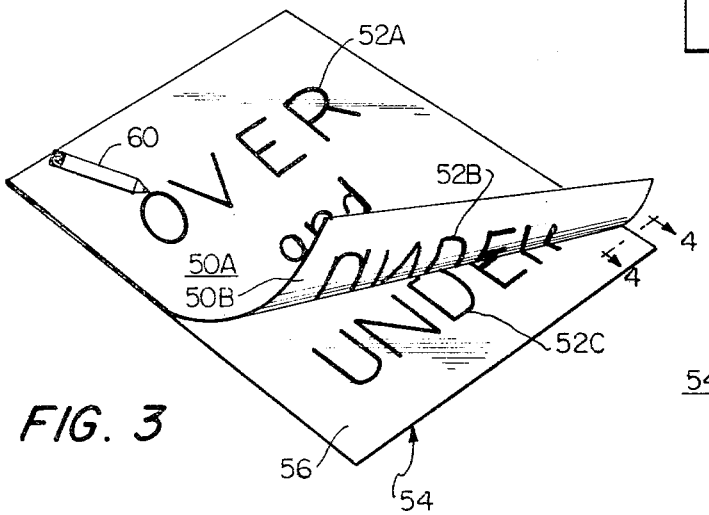
FIG. 3 is an illustration of a manifold combination of a transfer sheet of the present invention and a copy sheet of the present invention with a mirror image pattern having been transfered to the reverse face of the transfer sheet from the copy sheet.
Figure 4:
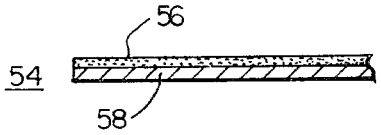
FIG. 4 is a detailed partial cross-section of a copy sheet of the present invention taken along line 4—4 of FIG. 3.

Then, as illustrated in FIG. 3, if a drafting implement 60 such as a pencil, ball pen, or the like is utilized to either generate the obverse pattern 52A or trace over the obverse pattern 52A on the obverse surface 50A, the pressure of the tracing or drafting point of the implement 60 will cause a mirror image transfer pattern 52B to be lifted from a counterpart pattern 52C on the copy sheet 54 do to the pressure transferable characteristics of the material layer 56 on the copy sheet 54.

At this point, the transfer sheet 50 is peeled upward as illustrated in FIG. 3 from the copy sheet 54 to separate it from the previously manifolded copy sheet for the purpose of next transferring the mirror image transfer pattern 52B to the surface of the T-shirt 62 or the like.

Figure 5:
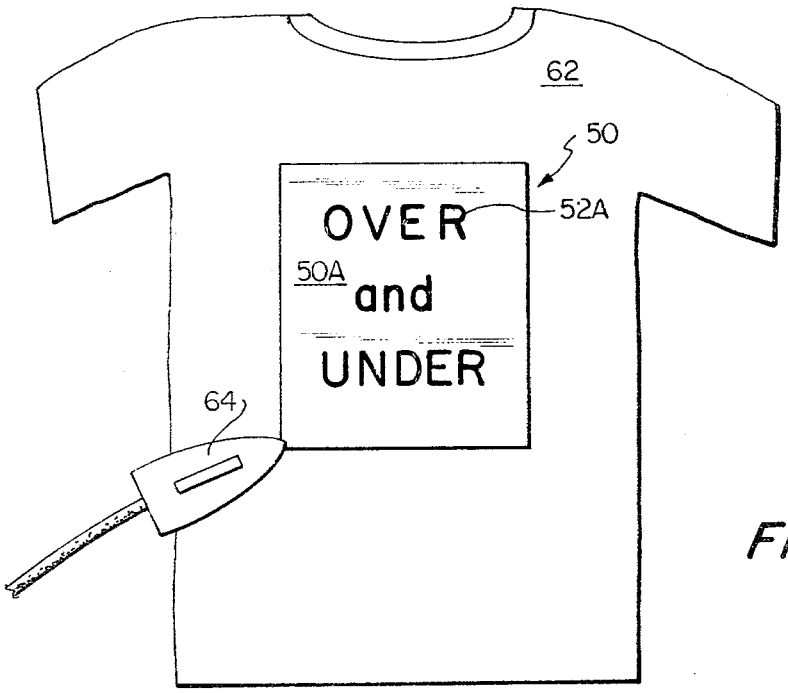
FIG. 5 is a schematic illustration of a heat transfer of mirror image from the reverse side of the transfer sheet to a T-shirt or the like by engaging the obverse surface and the obverse pattern with a hand iron or other heat applying implement.

As then shown in FIG. 5, the obverse pattern 52A is utilized as a visual registry to determine the proper position of the transverse sheet 50 on the T-shirt 62. A heating iron 64 is then pressed aginst the obverse surface 50A and obverse image 52A of the transfer sheet 50 to thereby transfer the transferable mirror image 52B onto the T-shirt 52 with the same result illustrated in step 3 of FIG. 1.

In the event that a multicolored mirror image is desired to thereby provide a multicolored transferred image on the T-shirt 62, then various portions of the obverse design 52A would be generated or traced with a different selected copy sheet 54 placed beneath the reverse surface 50B of the transfer sheet during those selected traces. These selected copy sheets 54 would be coated with different colored transferable layers 56 for the purpose of providing respectively selected colors to various portions of the transferable mirror image 52B on the reverse surface 50B of the transfer sheet 50.

The resulting multicolored mirror image would then be heat transferable to the T-shirt 62 as previously described.

As stated hereinbefore the heating step in any of the preferred embodiments may be replaced by the application of pressure to transfer the colored design.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

It is claimed:

1. A method of transferring a design from a transfer sheet to a fabric, comprising the steps of:

generating a design on the obverse surface of a transfer sheet by the application of energy thereto, while juxtaposing the rear surface of said transfer sheet with a layer of energy transferable material to provide a transferable mirror image of said design on the said rear surface, said transfer sheet including a pre-printed pattern and said design being generated by creating said design by hand to apply said energy to said obverse surface, said pre-printed pattern being used as a guide with respect to which said design is created;

placing said rear surface and said transferable mirror image of said design contiguous with a desired position on a surface of said fabric by visually aligning said design on said obverse surface with said desired position; and applying energy throughout the extent of said design on the obverse surface of said transfer sheet to transfer said mirror image from said rear surface to said desired area on said fabric to thereby reproduce said design on said fabric.

2. The method of claim 1 wherein said design is generated by tracing said pre-printed pattern.

* * * * *